US008577614B2

(12) United States Patent
Norris et al.

(10) Patent No.: US 8,577,614 B2
(45) Date of Patent: Nov. 5, 2013

(54) INFORMATION CHARACTERIZATION SYSTEM AND METHODS

(75) Inventors: Robert Norris, Kanata (CA); John H. Lake, Swift Current (CA)

(73) Assignee: Straterra Inc., Kanata (CA)

( * ) Notice: Subject to any disclaimer, the term of this patent is extended or adjusted under 35 U.S.C. 154(b) by 1129 days.

(21) Appl. No.: 12/300,598

(22) PCT Filed: May 14, 2007

(86) PCT No.: PCT/CA2007/000859

§ 371 (c)(1),
(2), (4) Date: May 14, 2007

(87) PCT Pub. No.: WO2007/131356

PCT Pub. Date: Jul. 7, 2009

(65) Prior Publication Data

US 2009/0271116 A1 Oct. 29, 2009

Related U.S. Application Data

(60) Provisional application No. 60/799,665, filed on May 12, 2006.

(51) Int. Cl.
*G06F 15/00* (2006.01)

(52) U.S. Cl.
USPC ..... 702/11; 702/6; 324/323; 73/152.01

(58) Field of Classification Search
USPC ..... 702/1, 6–14; 324/323; 706/929; 73/152.01
See application file for complete search history.

(56) References Cited

U.S. PATENT DOCUMENTS

| | | | | |
|---|---|---|---|---|
| 4,320,458 | A * | 3/1982 | Vincent | 702/6 |
| 4,542,648 | A | 9/1985 | Vinegar et al. | |
| 4,646,240 | A | 2/1987 | Serra et al. | |
| 4,692,910 | A | 9/1987 | Sondergeld et al. | |
| 5,012,674 | A | 5/1991 | Millheim et al. | |
| 5,109,697 | A | 5/1992 | Millheim et al. | |
| 5,193,059 | A | 3/1993 | Tiab et al. | |
| 5,706,194 | A | 1/1998 | Neff et al. | |
| 5,864,772 | A * | 1/1999 | Alvarado et al. | 702/9 |

OTHER PUBLICATIONS

Prof. Stephen A. Nelson, Carbonates & other rocks, Mar. 21, 2000.*

* cited by examiner

*Primary Examiner* — Jonathan C Teixeira Moffat
*Assistant Examiner* — Hien Vo
(74) *Attorney, Agent, or Firm* — Pearne & Gordon LLP

(57) ABSTRACT

The present disclosure provides a method of normalizing characterization information comprising: defining a plurality of characteristics, for each characteristic defining a set of allowed values and defining a logging interval. The method further comprises: at a plurality of logging intervals, selecting a value from the set of allowed values for a characteristic of the plurality of characteristics, and storing the selected value for the characteristics at the plurality of logging intervals. The present disclosure also provides a system for correlating log information comprising: a core set log data module for storing core set log data information, an electrical log data module for storing electrical log data information, a correlation module for correlating the core set log data information with the electrical log data information, and an input/output module for inputting and displaying the core set log data information the electrical log data information.

17 Claims, 12 Drawing Sheets

Lithology Symbols

| Rock Type | Symbol | Rock Type | Symbol |
|---|---|---|---|
| Annhydrite, secondary | | Limestone, grain supported | |
| Annydrite Primary | | Limestone, mud supported | |
| Bentonite | | Marlstone, calcareous | |
| Breccia | | Marlstone, dolomitic | |
| Chert Bedded | | Metamorphic | |
| Claystone Coloured | | Salt | |
| Claystone Grey | | Sandstone | |
| Coal Pure and Interbedded | | Shale, black | |
| Conglomerate | | Shale, coloured | |
| Dolomite | | Shale, grey | |
| Glacial Till | | Siderite, Limonite or Hematite | |
| Gypsum | | Siltstone | |
| Igneous, Acidic | | Tuff | |
| Igneous, Basic | | Welded Tuff | |

Figure 3a

Fauna Type

| Type | Symbol | Type | Symbol |
|---|---|---|---|
| Amphipora | | Intraclasts | |
| Belmnite | | Laminated | |
| Bioclastic or Fragmental | | Non-descript | |
| Brachiopod | | Oolites | |
| Bryozoa | | Ootoid | |
| Cepholopod | | Ostracod | |
| Coral | | Pelecypod | |
| Crinoid | | Pisolite | |
| Echinoid | | Pseudo Oolites or Pellets | |
| Foraminifera | | Scaphopod | |
| Fossils < 20% | F | Skeletal | |
| Gastropod | | Stromatoporoid | |

Figure 3b race Fossil Symbols

| Type | Symbol | Type | Symbol |
|---|---|---|---|
| Anconichnus | | Arenicolites | |
| Asterosoma | | Bergaueria | |
| Chondrites | | Conichnus | |
| Cylindrichnus | | Dipiocraterion | |
| Escape traces | | Gastrochaenolites | |
| Glossifungites | | Gyrolithes | |
| Helminthopsis | | Lockeia | |
| Macronichnus | | Monocraterion | |
| Ophiomorpha | | Palaeophycus | |
| Phycosiphon | | Planolites | |
| Rhizocorallium | | root traces | |
| Rosselia | | Schaubcylindrichnus | |
| Schaubcylindrichnus freyi | | Scolicia | |
| Siphonichnus | | Skolithos | |
| Teichichnus | | Thalassinoides | |
| Trebellina | | Trypanites | |
| Zoophycos | | | |

Figure 3c

Structures - Carbonates

| Type | Symbol | Type | Symbol |
|---|---|---|---|
| Bird's Eye / Fenestral | | Lateritic | |
| Burrows | | Mud cracks | |
| Chevron | | Neptunian Dykes | |
| Chicken Wire | | Nodular | |
| Cone-in-cone | | Salt hoppers | |
| Convoluted Bedding | | Soft Sediment Deformation | |
| Fracture- Vertical | | Solution Breccia | |
| Fracture-Horizontal | | Stromatactis | |
| Geopetal | | Stylolites | |
| Intraclasts and Lithoclast Ripups | | Teepee Structure | |
| Karsting | | Unconformity | |

Figure 3d

Structure - Clastic

| Type | Symbol | | |
|---|---|---|---|
| Bod | | Normal Grading | |
| Bouma Sequence | | Pebble Lag | |
| Burrows | | Reverse Grading | |
| Channel | | Rootlets | |
| Climbing Ripples | | Scour | |
| Current Ripples | | Scoured Surface | |
| Cut Bank | | Starved Ripples | |
| Graded Bedding | | Unconformity | |
| Horizontal Lamination | | Wave Ripples | |

Figure 3e

INFORMATION CHARACTERIZATION SYSTEM AND METHODS

FIELD OF THE INVENTION

The present invention relates, generally, to the characterization and analysis of information, and in particular to a tool for the characterization and analysis of rock information

BACKGROUND OF THE INVENTION

Geologists and petroleum exploration professionals routinely examine, classify and describe rock samples, called core samples, taken from existing and new oil wells, The information obtained from such examination may be used to determine whether or not to continue drilling in a current well, to predict the location of new oil-bearing deposits and to plan the best trajectories for new oil wells.

Information on various characteristics of the core samples are recorded at various intervals along the length of the core sample. This information is recorded manually on a core log data sheet. The sheets of the core data sets are not well suited to the storing, sorting, searching and sharing of the information contained in them.

In addition to the core sample data, additional information is often gathered for a well. The information can include electrical characteristics and chemical analysis, petrophysical analysis and compositional analysis. This information can be used when analyzing a well. However it is often difficult to correlate the information gathered from different methods.

What is need is a tool that allows for information to be entered, correlated and stored. It would be advantageous to provide a means for sharing the stored information.

SUMMARY OF THE INVENTION

In accordance with an aspect of the present disclosure there is provided a method of normalizing characterization information comprising: defining a plurality of characteristics, for each characteristic defining a set of allowed values and defining a logging interval. The method further comprises: at a plurality of logging intervals, selecting a value from the set of allowed values for a characteristic of the plurality of characteristics, and storing the selected value for the characteristics at the plurality of logging intervals.

In accordance with another aspect of the present disclosure there is provided a system for correlating log information comprising: a core set log data module for storing core set log data information, an electrical log data module for storing electrical log data information, a correlation module for correlating the core set log data information with the electrical log data information, and an input/output module for inputting and displaying the core set log data information the electrical log data information.

In accordance with another aspect of the present disclosure there is provided a propagated signal carrier carrying signals containing computer-executable instructions that can be read and executed by a computer, the computer-executable instructions being used to execute a method of normalizing characterization information comprising: defining a plurality of characteristics, for each characteristic defining a set of allowed values and defining a logging interval. The method further comprises: at a plurality of logging intervals, selecting a value from the set of allowed values for a characteristic of the plurality of characteristics, and storing the selected value for the characteristics at the plurality of logging intervals.

In accordance with another aspect of the present disclosure there is provided a computer-readable medium storing instructions or statements for use in executing in a computer a method of normalizing characterization information comprising: defining a plurality of characteristics, for each characteristic defining a set of allowed values and defining a logging interval. The method further comprises: at a plurality of logging intervals, selecting a value from the set of allowed values for a characteristic of the plurality of characteristics, and storing the selected value for the characteristics at the plurality of logging intervals.

BRIEF DESCRIPTION OF THE DRAWINGS

Embodiments of the present disclosure will now be described with reference to the accompanying drawings in which:

FIGS. 3*a-e* show in a diagram sets of possible symbols for characteristics, in accordance with an aspect of the present disclosure;

DETAILED DESCRIPTION

The invention automates the collection of Core Log data by formalization and "objectification" of what is often subjective data interpretation process through:

- the consolidation of all types of data in one place and in one computer-readable format;
- the combination of the data both visually and programmatically for analysis;
- rapid and accurate correlation of various types of data and the adjustment of one class of data against another (e.g., Core Log depth adjusted by Electrical Log depth, as well as TVD and deviated well depth correction);

the formal application of both energy and its rate of change and of grain size, for clastic rocks, and Dunham's classification for carbonate rocks, to develop a weathering profile; and the determination of the position of 'list rock' from electrical log or core analysis data.

Figure 1:
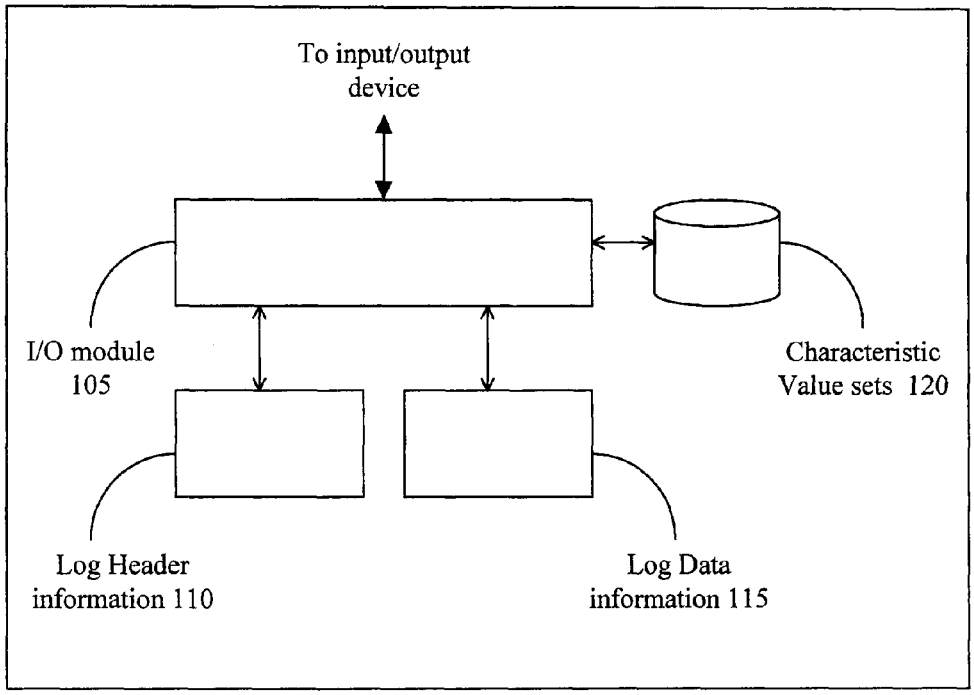
FIG. 1 shows in a functional schematic an automated Log Manager tool, in accordance with an aspect of the present disclosure.

FIG. 1 shows, in a functional schematic, an automated Log Manager tool 100. The automated Log Manager tool 100 comprises an I/O module 105 that provides for the input and display of Log Header information 110 and Log Data information 115. The Log Header information may be used to describe a well, including the well location, well Name, longitude and latitude and the elevation of the well head, and a core sample from the well, including core set number, number of boxes of rock, the amount of rock recovered and the top and bottom depths of the core sample. The Log Data information 115 may be used to describe characteristics of rock in the core taken from the well described in the Log Header information 110. The Log Data information 115 comprises a plurality of characteristic-value pairs. The Characteristic Value Sets 120 provide sets of allowed values for various characteristics of the Log Data information 115. The tool 100, as descried, is optimized for carbonate and clastic sedimentary rock. The tool 100 could be modified to describe other types of sedimentary rock such as coal or metamorphic or igneous rock types.

Characteristics of the rock in a core sample may be determined at varying positions along its length. The positions are normally spaced an equal distance apart. The distance is chosen depending on the desired level of detail of information. A smaller interval provides more detail. At each interval the characteristics are observed and a value is inputted into the I/O module 105 of the tool 100. The I/O module 105 uses the Characteristic Value Sets 120 to present the values that are allowed to be entered for a particular characteristic.

The Log Data Information 115 describes the values of characteristics for a core at a number of intervals. The I/O module 105 may display the Log Data Information 115 in a table form, with the various characteristics forming the columns, and the intervals that the characteristics were determined at forming the rows. The cell stores the value of the column characteristic determined at each row interval.

A listing of possible Log Header information that may be inputted and displayed, along with a description each is provided below.

Log Date field: The Log Date field sets the date that the log is opened. When a new log is opened, the default date is the current date.

Well Location field: The Well Location field is a structured field that can format the entry in a URI format. The Well Location is used in combination with the Core Set Number to name a core set data maintained by the Log Manager tool.

Well Name field: The Well Name field is a free-form text field that can be used to identify a particular well.

Well Field: The Well Field field is a free-form text field that can be used to identify a particular field a well is in.

Core Set Number field: The Core Set Number field is a number used to identify a core set taken from a well. A well may have a series of core sets taken at varying depths. The Core Set number is used in combination with the Well Location to uniquely name the core set in the Log Manager.

Number of Boxes field: The Number of Boxes field is a number used to indicate the number of boxes that the core set samples are stored in.

Recovery field: The Recovery field is a number indicating the actual amount of rock recovered in the core sample, that is if sample contains less than the amount indicated by the Top and Bottom fields Core Set Top field: The Core Set Top field is a number indicating the top (highest) depth of the core set currently displayed.

Core Set Bottom field: The Core Set Bottom field is a number indicating the bottom (lowest) depth of the core set currently displayed.

Logged By field: The Logged By field is a free-form text field that allows for the name of the person logging the core to be specified.

Well Latitude field: The Well Latitude field is a numeric field with the format dd.dd D. mm.mmm.M, where dd.dd represents degrees, and mm.mmm represents minutes that indicated the latitude of the well head.

Well Longitude field: The Well Longitude field is a numeric field with the format dd.dd D. mm.mmm.M, where dd.dd represents degrees, and mm.mmm represents minutes that indicated the longitude of the well head.

KB Elevation field: The KB Elevation field is a number indicating the elevation of the Kelly Bushing on the drilling rig.

Ground Elevation field: The Ground Elevation field is a numeric field indicating the ground elevation of the well.

Core On Depth field: The Core On Depth field is a display only field, computed by the tool, that shows the difference between the Core Depth, as measured in the core sample, and the Electrical log depth, as measured when the electrical log was taken. An electrical log column and an electrical log depth column must be inserted by the E Log Manager for this field to contain a value.

Log Type field: There are templates for Carbonate core types and for Clastic core types. Other types such as coal or hard rock may also be part of the tool.

Logging Units field: The Logging Units field sets the units of measurement for the well and core. It can be set to one of metric or FPS. Metric is in meters, or fractions thereof and FPS (feet pounds seconds) is in feet and inches.

Logging Interval field: The Logging Interval field sets the logging interval. The values displayed depend on the units specified in the Logging Units field. The logging interval field determines the interval at which characteristics are entered for a core set. The logging interval is typical chosen depending on the amount of detail required for a core set. The more detailed required the smaller the logging interval.

Possible core set characteristics that may be determined at each interval for core rock and inputted into the Log Data information 115 or displayed include: Lithology, Dunham's classification, clastic grain size, carbonate grain size, carbonate energy/grading, clastic energy/grading, bioturbation, texture, fauna, trace fossils, carbonate structure, clastic structure, sorting, compaction, shape, oil stains, diagenesis, facies, depositional system and porosity. Other characteristics may also be necessary for clastic, carbonate or other sedimentary rock types or for metamorphic or igneous rock.

The Characteristic Value sets 120 is used to define the allowed values for various characteristics of the core set determined at the intervals. All sets of values, below, are initial sets. The present disclosure allows for additional symbols to be added as they are standardised (in the case of normalised data) or required for a specific purpose. Example values for characteristics are listed below.

Lithology values: Annhydrite, Secondary; Annhydrite, Primary; Bentonite; Breccia; Chert Bedded; Claystone Coloured; Claystone Grey; Coal Pure and Interbedded; Conglomerate; Dolomite; Glacial Till; Gypsum; Igneous, Acidic; Igneous, Basic; Limestone, grain supported; Limestone, mud supported; Marlstone, calcareous; Marlstone, dolomitic; Metamorphic; Salt; Sandstone; Shale, black; Shale, coloured; Shale, grey; Siderite, Limonite or Hematite; Siltstone; Tuff; Welded Tuff, Lost Rock Fauna values: Amphipora; Belmnite; Bioclastic or Fragmental; Brachiopod; Bryozoa; Cepholopod; Coral; Crinoid; Echinoid; Foraminifera; Fossils<20%; Gastropod; Intraclasts; Laminated; Non-descript; Oolites; Ootoid; Ostracod; Pelecypod; Pisolite Pseudo Oolites or Pellets; Scaphopod; Skeletal; Stromatoporoid Trace fossil values: Anconichnus; Asterosoma; Chondrites; Cylindrichnus; Escape traces; Glossifungites; Helminthopsis; Macronichnus; Ophiomorpha; Phycosiphon; Rhizocorallium; Rosselia; Schaubcylindrichnus freyi; Arenicolites; Bergaueria; Conichnus; Diplocraterion; Gastrochaenolites; Gyrolithes; Lockeia; Monocraterion; Palaeophycus; Planolites; root traces; Schaubeylindrichnus; Scolicia; Siphonichnus; Teichichnus; Trebellina; Zoophycos; Skolithos; Thalassinoides; Trypanites Carbonate Structure values: Bird's Eye/Fenestral; Lateritic; Burrows Mud cracks; Chevron; Neptunian Dykes; Chicken Wire; Nodular; Cone-in-cone; Salt hoppers; Convoluted Bedding; Soft Sediment Deformation; Fracture-Vertical; Solution Breccia; Fracture-Horizontal; Stromatactis; Geopetal; Stylolites; Intraclasts and Lithoclast Ripups; Teepee Structure; Karsting; Unconformity Clastic Structure values: Bedding; Normal Grading; Bouma Sequence; Pebble Lag; Burrows; Reverse Grading; Channel; Rootlets; Climbing Ripples; Scour; Current Ripples; Scoured Surface; Cut Bank; Starved Ripples; Graded Bedding; Unconformity; Horizontal Lamination; Wave Ripples Carbonate Grain Size values: Very Coarse; Coarse; Medium; Fine; Very Fine Shape values: Angular; Subanbular; Subrounded; Rounded; Well Rounded Oil Stain values: Light; Medium; Heavy Diagenesis values: Compaction; Recrystilisation; Solution; Cementation; Authigenesis; Replacement; Bioturbation Facies values: Anoxic lagoon; Reef margin; Anoxic/shallow lagoon; Restricted lagoon; Argillaceous lagoon; Restricted lagoon/crinoid bank; Argillaceous/hypersaline lagoon; Restricted lagoon/beach; Argillaceous/very restricted lagoon; Restricted/shallow lagoon; Bank; Shoal; Beach; Silty/argillaceous lagoon; Channel/lagoon; Silty lagoon; Crinoid bank; Tidal flat; Crinoid shoal; Very restricted/restricted lagoon; Hypersaline lagoon; Very restricted lagoon; Mud-mound; Very restricted/hypersaline lagoon;

Depositional values: In-channel bar; Upper shoreface; Barrier bar; River bed; Point bar; Beach; Lower shoreface; Channel/lagoon; Tidal flat Compaction values: Not compacted; Slightly compacted; Compacted; Strongly compacted; Friable; Indurated; Hard Sorting values: Unsorted; Very poorly sorted; Poorly Sorted; Poorly to moderately well sorted; Moderately well sorted; Well sorted; Very well sorted; Unimodally sorted; Bimodally sorted Clastic Grain Size values: Pebble; Grain; Sand-Very Coarse; Sand-Coarse; Sand-Medium; Sand-Fine; Sand-Very Fine; Silt Clay Dunham's values: Crystalline; Boundstone; Grainstone; Packstone; Wackestone; Mudstone Clastic Energy/Grading values: Coarsening Upward Rapidly; Coarsening Upward Slowly; Coarsening Upward Uniformly; Fining Upward Rapidly; Fining Upward Slowly; Fining Upward Uniformly Carbonate Energy/Grading values: Coarsening Upward Rapidly; Coarsening Upward Slowly Bioturbation values: Absent; Rare; Sparse; Moderate; Common; Intense;

Texture values: Chalky; Crypto; Microcrystalline; Sucrosic

Porosity values: 10, 20, 30, 40, >40

In addition to the characteristic values described above, it is also possible to include user defined values for the characteristics. The user defined characteristics are identified as such. This allows for the tool to treat the user defined values correctly. This may include ignoring the values. Alternatively user defined values may be further analysed by add-on modules that recognize the values.

The Characteristic Value Set 120 allows for the normalization of inputted data. This provides for standardized values for the different characteristics. The Characteristic Value Set 120 may be implemented in various ways. It may be a flat file that the I/O module 105 opens and retrieves the allowed values from. It may be a data base or similar structure that stores the allowed values for each characteristic. It may be a module that the I/O module uses to determine the allowed values.

A company or individual that is characterizing and analyzing core sets may use the Characteristic Value Set 120 to provide a person or company responsible for carrying out the characterization of the core sets with the set of standard values used by the company. In this way a company may have multiple different people or companies perform the characterization of core sets, and all of the data will be consistent.

Figure 2:
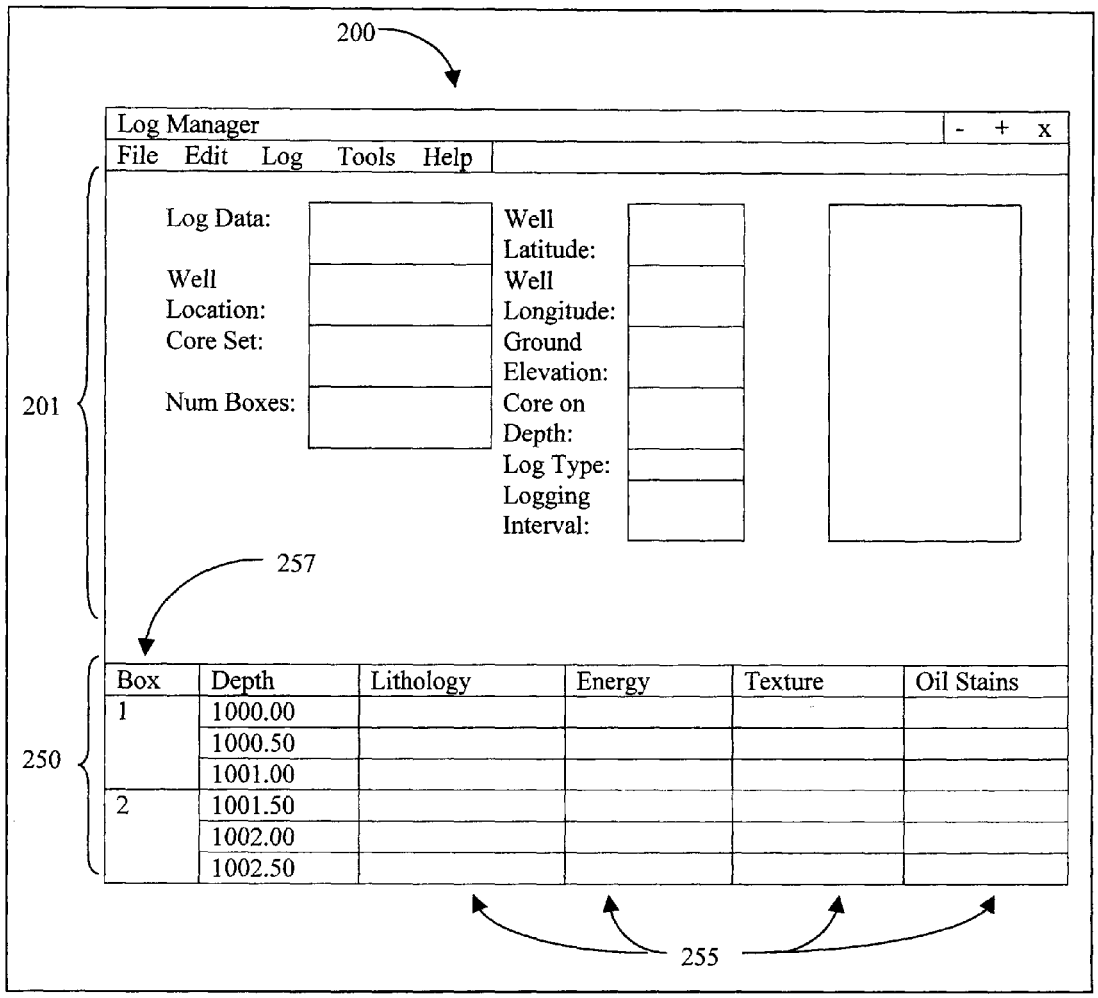
FIG. 2 shows in a schematic a graphical user interface for the automated Log Manager tool, in accordance with an aspect of the present disclosure.

FIG. 2 shows in a schematic a graphical user interface (GUI) 200 for the automated Log Manager tool 100, that provides for the input and display of Log Header information 110 and Log Data information 115. For the sake of clarity, FIG. 2 depicts only a representation of the information that may be displayed by the GUI 200. Characteristic values are not shown, but may be included in the cells. It is understood that additional information may be added, and the location or display of the information may be modified.

The GUI 200 comprises two main areas. The Well/Core information panel 201, and the Log Data information panel 250. The Well/Core information panel 201 displays the Log Header information 115. This may include the Log Header information previously described and a logo that may represent the company performing the characterization, the owner of the well, etc.

The Well/Core information panel 201 may also display information pertaining to the core set associated with the Log Data information 115 displayed in the Log Data information panel 250 such as the top and bottom depths of the core set, the core set number (if multiple core sets are associated with the well), the number of boxes in the core set and the logging interval used to determine the characteristics of the core set.

The logging interval is chosen to provide an appropriate level of granularity, based on standard practice. At the well or drill sight, core samples are placed in standard sized boxed. For carbonate and clastic rock these boxes hold two 0.75 meter (metric) or two 30 inch (FPS) lengths of rock. Generally the amount of rock in each section is less that 1.5 meters/60 inches because, on the drilling rig the rock is split at random intervals as it is removed from the well. The tool provides variable sized cells that represent core boxes and allows box cells to span varying number of interval rows The Log Data Information panel 250 is structured as a table. The columns represent characteristics that may be inputted, and the rows represent the interval at which each value is determined. The interval may be displayed as a depth. This is possible since the depth of the top of the core sample is known (documented when removed from the well) and the length of each interval is known (the logging interval). Each cell represents the value of the column characteristic that is determined at the row depth (or interval). The GUI 200 shows four characteristics 255: Lithology, Energy, Texture, and Oil Stains. An additional column 257 shows the box number that the section of core sample is stored in. Since a section of core sample may have numerous logging intervals, the box number merges the appropriate number of cells together. This may also be done for the Energy characteristic as will be described later.

Each characteristic that may be determined at each interval can be displayed in the appropriate cell of the Log Data information panel 250. Various ways of displaying the information are possible, such as using text or numbers to represent the value. It may be easier to interpret the Log Data information if it is presented in a graphical form. This is accomplished by associating a graphic, icon or symbol with each value for a characteristic. This is particularly useful for the lithology, fauna, trace fossil, and structures characteristics. A set of possible symbols or graphics for each of these characteristics if shown in FIGS. 3*a-e*. Other characteristics, such as grain size, texture, bioturbation, porosity, structures, sorting, compaction and shape may be more appropriately displayed as characters, strings or numbers.

In addition to defining the allowed values of characteristics, the Characteristic Value Set 120 can also be used to associate the display characteristic with the value. In this manner, the Characteristic Value set 120 normalizes the values of characteristics as well as how they are displayed in the Log Data information panel 250.

The rock samples of the core set may include formations and strata. Formations and strata (beds) are geological structures that denote boundaries between sedimentary rock types. Beds may be specified by selecting the intervals that comprise the bed. Using the GUI 200 this may be accomplished by selecting the cells representing the intervals that form the bed, right clicking on the depth column. This brings up a dialog that allows for a bed to be created. It is possible to define a bed in other ways. A create bed selection may be included in a menu. When selected, the create bed selection may display a dialog that prompts for the input of the intervals forming the bed. Alternatively a bed column may be included in the Data Log information panel 250. The intervals may be selected from the bed column, and a bed created by right clicking on the bed column. Although not shown in FIG. 2, a bed may be graphically indicated by including a horizontal line across all of the characteristic columns above and below the intervals of the bed. Once a bed is defined a value for the energy gradient of the bed may be selected from allowed values for the energy gradient defined in the Characteristic Value Set 120.

One or more Formations may be defined each spanning a set of one or more beds. A formation may be defined for an individual bed, however formations are normally defined for a span of beds. A formation may be defined in a similar way as defining a bed described above, however a text string is also inputted which describes or identifies the formation. A formation may be displayed in a column (not shown) on the Data Log information panel 250. The rows of the intervals of the beds forming the formation may be merged and the string describing, or identifying the formation may be displayed in the merged cells.

Certain characteristics for an interval may include multiple values. For example, the values of the Trace Fossil characteristics describe different types of fossils. A particular interval may include one or more fossils. To indicate the presence of the different types of Trace Fossils, multiple values may be entered for the fossil characteristic for an interval. It is understood that each value of the multiple values is selected from the allowed values as defined in the Characteristic Value set 120. Certain characteristics, such as the fauna characteristic may also allow the selection of multiple values. Other characteristics that may allow multiple values to be selected include trace fossils. If the values are displayed as icons or graphics they may be displayed in the appropriate column. If multiple icons are present they may need to be scaled to fit in the column. Alternatively a small icon may be displayed indicating that more icons are present. When the small icon is clicked a fly out or dialog may be displayed that shows all of the icons for the selected values for the characteristic.

The characteristics and values described pertain to clastic and carbonate rock types. A core set is typically of one type of rock. When creating a core set the type of rock may be selected. This will select the characteristics commonly used to define the rock type. For example, carbonate rocks are typically described with Dunham's classifications, while clastic rocks are not. As such when the core set is specified as a carbonate type rock, the characteristics may include the Dunham classification column. The characteristics that are to be included when describing a rock type may be contained in a template file. When creating a new log for a core set the tool 100 may display a list of the templates found, one of which may be selected. The appropriate characteristics may then be displayed on the Log Data information panel 250. Additional characteristics may be added to a template file. This may be used to describe core samples that contain different types of rock, for example a bed of clastic rock in a largely carbonate core sample.

Similar to the Characteristic Value set 120, template files may be used advantageously to indicate the characteristics of a core set that are to be determined and inputted into the tool 100. The allowed values, and optionally the display properties, of the characteristics defined in the template file should be specified in the Characteristic Value sets 120.

Although the above description describes the characteristics and possible allowed values of the characteristics that are commonly used in describing carbonate and clastic rock types, the template file and Characteristic Value sets 120 provide a means of defining new rock types that can be characterized and analysed using the tool 100. This can be accomplished by specifying the characteristics that are appropriate for describing the new rock type in a template file, and the allowed values of the characteristics in a Characteristic Value Set 120. When a new core set is to be characterized, the tool 100 can search for template files and allow the selection of the appropriate template. This would load the appropriate characteristics into the GUI 200. The values for each characteristic at an interval may the be selected from the allowed values for the particular characteristic as defined in the Characteristic Value Set 120.

Figure 12:
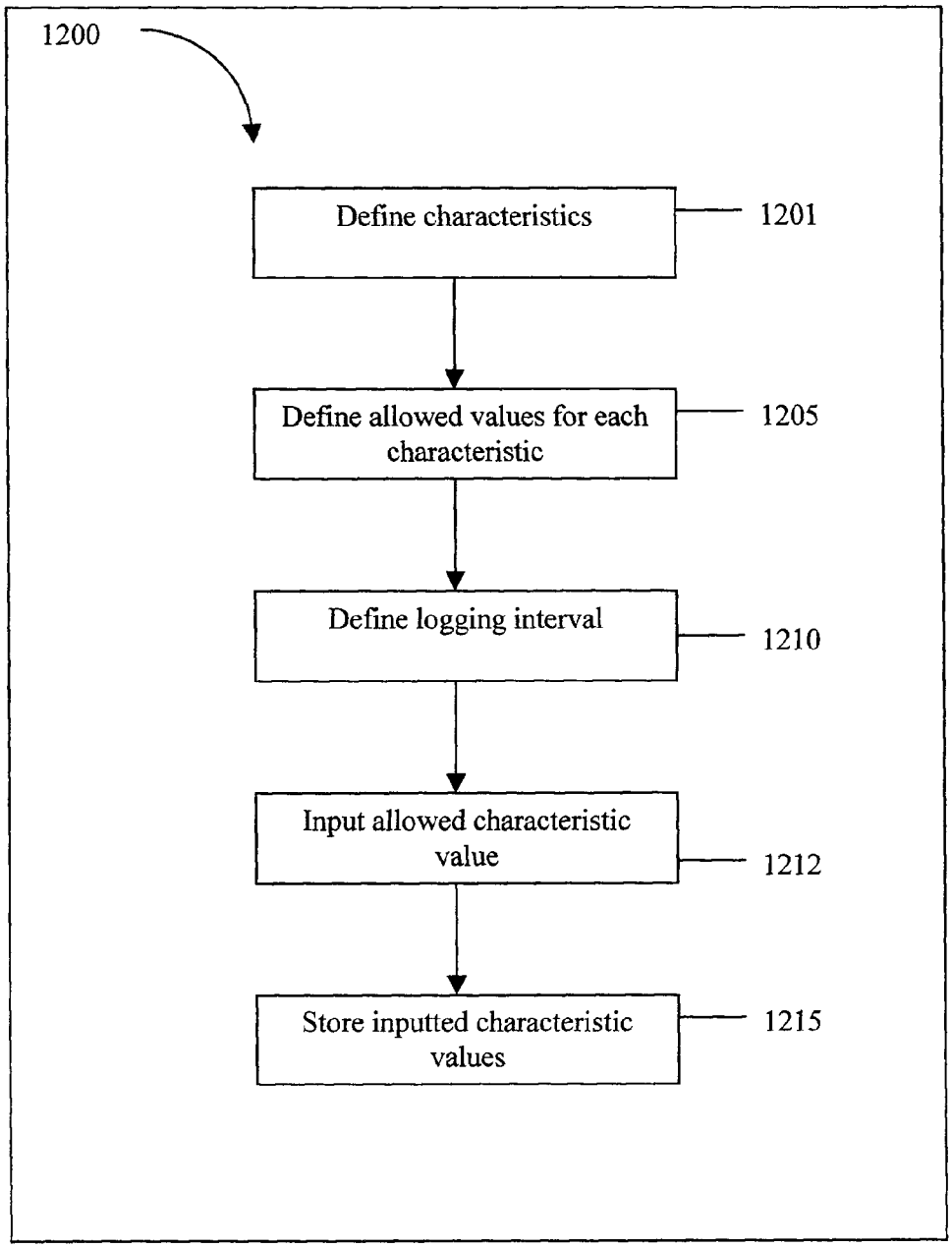
FIG. 12 shows in a flow chart, a method of normalizing characterization information, in accordance with an aspect of the present disclosure.

FIG. 12 shows in a flow chart, a method 1200 of normalizing characterization information in accordance with the present description. The method comprises the steps of defining a plurality of characteristics to be determined (1201). For each characteristic defined, a set of values that are allowed to described the characteristic is defined (1205). A logging interval is defined which the characteristics are evaluated at (1210). The values of the characteristics at the logging intervals are inputted (1212). The inputted values are then stored (1215).

In addition to the various characteristics already described, the automated Log Manager tool 100 may also be used advantageously to provide a simple means of entering weathering information. Previously, weathering information was typically drawn over the lithology characteristics by hand. The tool may be used to automate this process.

Figure 4:
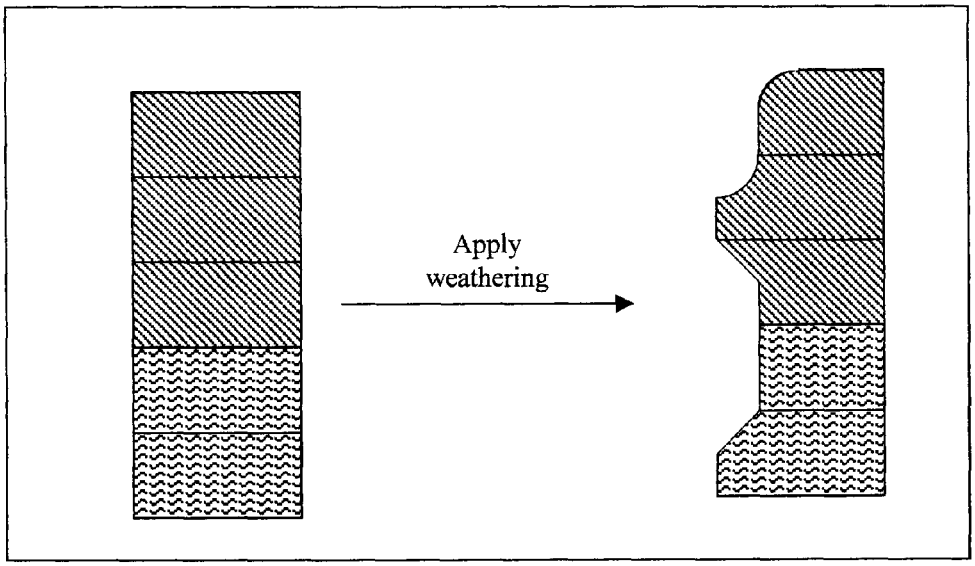
FIG. 4 depicts in a schematic a representative lithology column before and after applying the weathering characteristics, in accordance with an aspect of the present disclosure.

FIG. 4 depicts in a schematic a representative lithology column before and after applying the weathering characteristics. The weathering information is displayed as a mask or cut-out of the lithology column. A mask is determined for each interval. The tool 100 advantageously uses the information of other characteristics when determining the mask to apply to each interval.

The tool may create the weathering mask automatically when ever enough information is present in the Log Data. That is, if an interval contains information on the grain size and energy gradient, a weathering mask may be applied to the lithology column. A partial weathering mask may also be created, based on the available information. That is, if the required information is available a weathering mask is created and applied. If the information is not present then no weathering mask is created. Options may be provided to hide or show the weathering masks. Alternatively to automatically creating the weathering mask, an option may be available to apply the weathering, such as by right clicking on the lithology column and selecting an apply weathering option. This may be advantageous as weathering information will not be continually reapplied as information is input and corrected.

For clastic rocks the appropriate mask is determined using values of two characteristics. The first is the grain size characteristic. This determines the amount that the weathering amount and determines how far the mask or cut-out will indent into the lithology column. The indent amounts for the grain size values described above is provided in table 1 below.

TABLE 1

Clastic Weathering Amounts

| Grain Size | % of full indent |
|---|---|
| Pebble | 10 |
| Grain | 20 |
| Sand-Very Coarse | 30 |
| Sand-Coarse | 40 |
| Sand-Medium | 50 |
| Sand-Fine | 60 |
| Sand-Very Fine | 70 |
| Silt | 80 |
| Clay | 90 |

The second characteristic used to determine the weathering mask is the energy gradient of the bed that the interval is part of. The energy value is used to select a mask type that is applied at the correct indent as determined from above. The mask types corresponding to the clastic energy gradient values described above are provided in table 2.

TABLE 2

Clastic Weathering Mask Types

| Energy/Gradient value | Weathering Mask |
|---|---|
| Fining Upwards Rapidly | |
| Fining Upward Slowly | |
| Fining Upward Uniformly | |
| Coarsening Upwards Rapidly | |
| Coarsening Upward Slowly | |
| Coarsening Upward Uniformly | |

It is possible to create weathering masks based upon different characteristics. For example, when creating a weathering mask for carbonate rock types, the tool 100 uses the Dunham characteristic value to determine the indent position of the mask. The shape of the mask used for a given interval is determined based on the indents of the intervals above and below the interval for which the mask is being created. The indent amounts for the Dunham values described above are provided in table 3.

TABLE 3

Indent value according to Dunham value

| Dunham value | % of full indent |
|---|---|
| Crystalline | 0 |
| Boundstone | 0 |
| Grainstone | 10 |
| Packstone | 50 |
| Wackstone | 60 |
| Mudstone | 90 |

In addition to the characteristic information that may be determined from core sets described above, the automated Log Manager tool also provides a way of inputting and displaying information resulting from analysis performed on the core sets. The analysis may include chemical analysis, petrophysical analysis, compositional analysis etc.

It is common for plugs (small cylinders of rock) to be taken from sections of the core sample in order to perform detailed analysis by specialized labs. The section of the core sample that the plug is taken from, and so a corresponding depth, and other information that may be used to identify the plug, is sent to the lab. The Lab may perform various tests on the plugs which result in a set of values representing the test results. Since the depth of the plug is known, the test results can correlated to a depth. The labs typically returns the information in a machine readable format such as comma separated value (CSV) file format or spreadsheet file. The file specifies the depth and the value of the test results at the particular depth.

Figure 5:
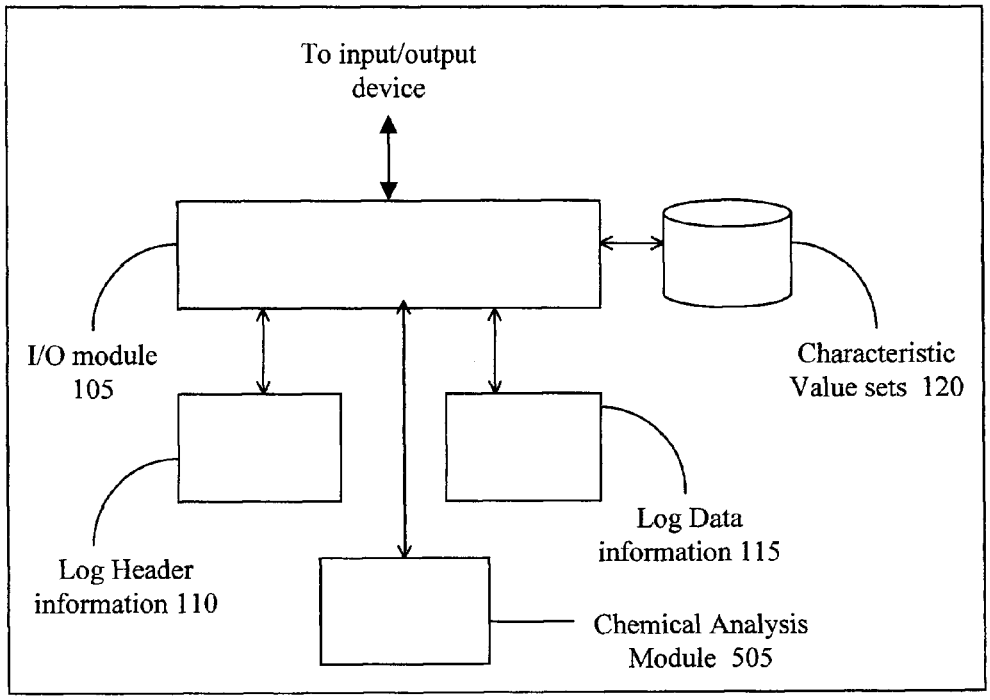
FIG. 5 shows in a functional schematic a tool including an analysis module, in accordance with an aspect of the present disclosure.

FIG. 5 shows in a functional schematic a tool 100 including an analysis module 505. The tool 100 can import the analysis files and display them using the analysis module 505. The depth scale of the analysis data may be aligned with the corresponding depths of the core log data. The information may be displayed in various ways. The results may be displayed in a dialog graphically indicating the test performed, or the results displayed as a chart of the value/depth pairs contained in the file. Alternatively or additionally, the information may be displayed in the GUI 200. This may be achieved by adding a column to the Log Data information panel 250 for each test performed that is to be displayed. The information may then be presented in the column at the appropriate depth by using the result value to determine the percentage of the column to fill with a bar or other graphic. In addition to importing and displaying the analysis information, the tool may also store the information with the Log Data information 115.

Typical characteristics determined by lab analysis include:

Kmax (mD)—maximum permeability (millidarcies)

Kvert (mD)—permeability measured vertically,

K90 (mD)—permeability measured horizontally

Porosity (%), —the void space in the rock reported as a percentage

Grain Density (kg/m3)—the density of the grains in a formation or core sample

Figure 6:
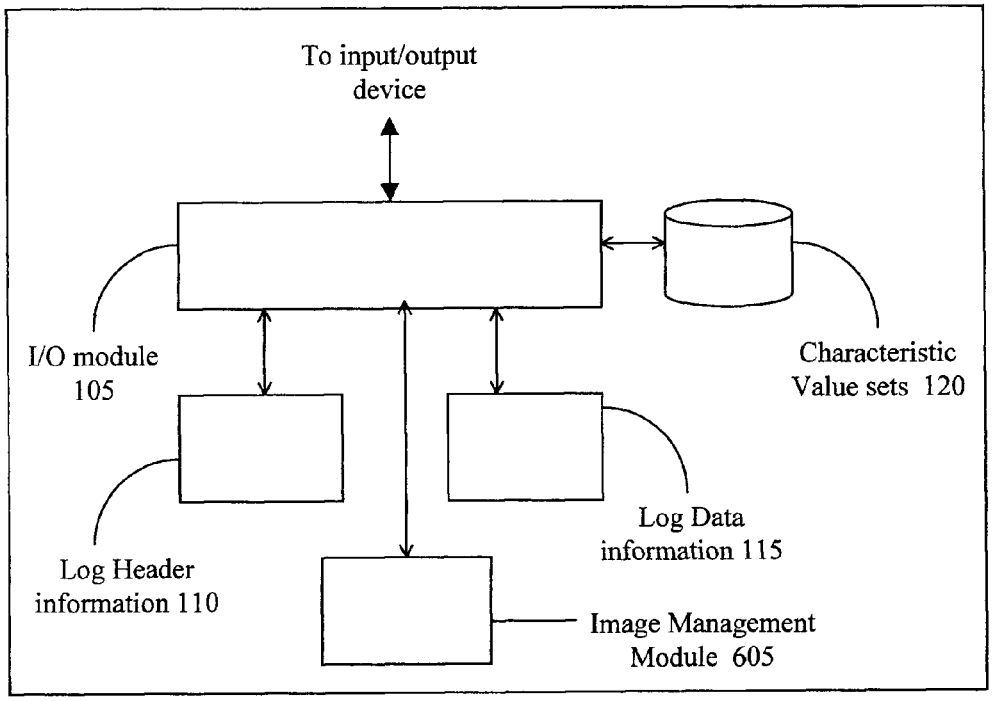
FIG. 6 shows in a functional schematic a tool including an image management module, in accordance with an aspect of the present disclosure.

Bulk Density (kg/m3)—the mass of many particles of the material divided by the volume they occupy RSat Oil Ratio—oil to gar ratio RSat Water Ratio—oil to water ratio FIG. 6 shows in a functional schematic a tool 100 including an image management module 605. Images of the core samples are often taken to provide visual confirmation of the log data. The automated core management tool 100 provides a way of incorporating these images into the tool and stored in the core dataset using the image management module 605. The image management module 605 may be used to associate an image of a box containing the core samples with the corresponding box in the Log Data. The image management module provides image editing functionality so that an image of a box may be cropped and aligned properly. Other image editing functionality may also be provided such as image enhancement functionality. The GUI 200 may display the image associated with a box in a dialog when the box is clicked on. Alternatively or additionally the image management tool may display the image in a rock characteristic column or in a dialog containing the images associated with all of the boxes.

The GUI 200 can include an image column that displays the image of the section of the core set. In this case it may be necessary to crop an individual core section from the box image since a box contains two core sections. If an image column is included in the GUI, instead of displaying an actual image of the core sample, it may display an icon indicating that an image is associated with the section. When an image column with an associated core image is clicked, the tool may display the actual image associated with the section. This may be used if the image column is too small to display an accurate image.

In addition to the functionality described above, the image management module 605 may also provide note functionality. This allows for a note to be associated with a particular place on the image. This can be achieved by storing the location of the note as x and y image coordinates in a file with associated text. The note feature may be used to identify locations of interest, of unknown features, etc Additionally the note feature may be used to indicate the location that plugs were taken from. In this case the note text may be used to associate the results of the analysis with the note. Clicking on a note location that has associated test results may result in the test results being displayed.

Other types of data that are collected may be included in the automated log management tool 100. For example once the core samples are removed from a well, electrical information may be gathered. The electrical information may be obtained by lowering appropriate instruments down the well. The instrument is then pulled back up and the measurements recorded by well depth. The measurements obtained in this manner provide an accurate correlation between the value of the measurement and the depth the measurement was taken at. This can be achieved since the instrumentation is lowered on a wire or the like, and so the location of the instrument in the well can be determined from the length of wire suspending the instrument.

The electrical measurements may be recorded on a strip chart recorder or in a digital form such as a LAS (Log ASCII Standard) file. A Strip Chart recorder provide a raster image of the recorded quantities on a piece of paper. The LAS file describes the measurements that are present in the file, as well as the measurement values taken at a corresponding depth. The tool 100 allows for the measurement information to be imported and displayed either by importing a digital raster image of a strip chart recording or by graphing the values contained in a LAS file. When an electrical log file is to be imported it is opened. The tool 100 can read, using an electrical log module, the measurements present in the file and allow for the selection of the measurements to be displayed. Examples of possible measurements are:

DT.(US/M)—SONIC TRANSIT TIME

RHOB.(K/M3)—BULK DENSITY

NPHI.(V/V)—NEUTRON POROSITY

SFLU.(OHMM)—RXO RESISTIVITY

SFLA.(OHMM)—SHALLOW RESISTIVITY

ILM (OHMM)—MEDIUM RESISTIVITY

ILD.(OHMM)—DEEP RESISTIVITY

SP.(OHMM)—SPONTANEOUS POTENTIAL

GR.(GAPI)—GAMMA RAY

CALI.(MM)—CALIPER

DRHO.(K/M3)—DENSITY CORRECTION

Figure 7:
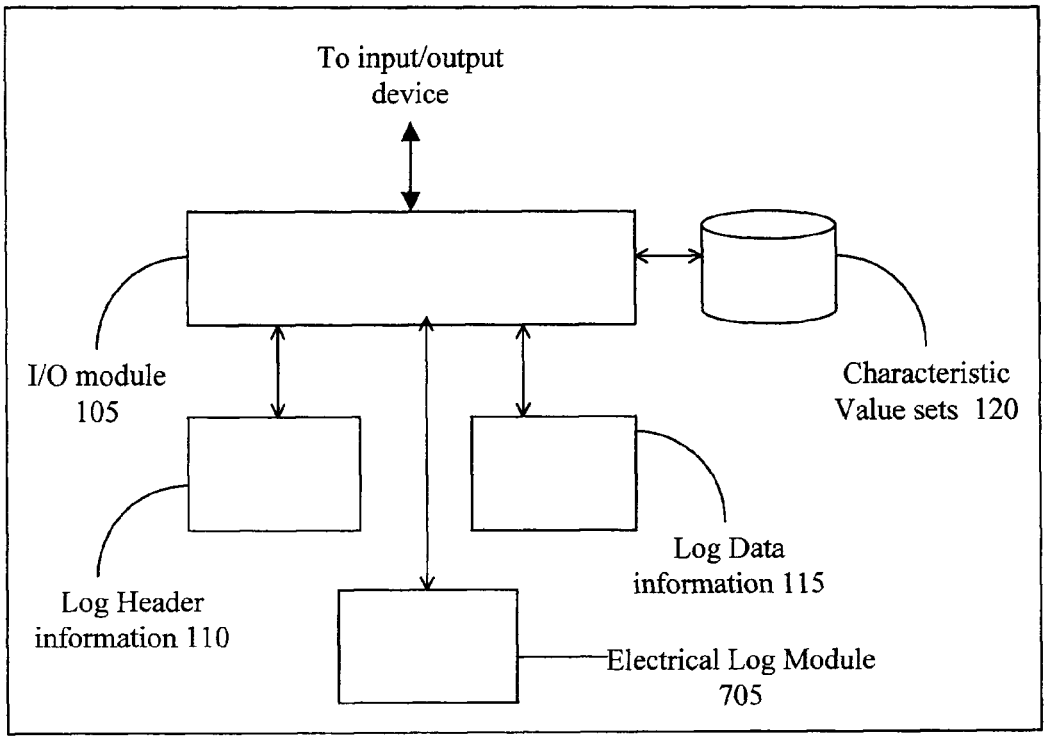
FIG. 7 shows in a functional schematic a tool including an electrical log module, in accordance with an aspect of the present disclosure.

FIG. 7 shows in a functional schematic a tool 100 including an electrical log module 705. The GUI 200 may display the electrical log information. Electrical log data is the output of separate operation, not part of the core logging process, whereby measuring equipment is lowered into the well, withdrawn and measurements taken at regular depth intervals. Electrical log data may be displayed by adding two columns to the Log Data information panel 250. One of the columns is used to display the depth the measurements were taken at. The other column is used to display the value of the measurement. If multiple measurements are to be displayed, additional columns may be added. It is also possible to display the measurement information as a graph. In this case the cells of the measurement column are merged and the values graphed in the column with the depth column as an axis and the column width as the other axis. If the measurements are displayed as a graph, multiple measurements may be displayed in the same column.

Some electrical instruments may not be able to record the measurement information in a digital form. In this case the instruments may record the information in a continuous graph, or strip log. The depth can be accurately correlated to strip logs as is possible with digital measurements. This is possible since the depth is also recorded as the instrument is lowered into or removed from the.

Strip logs may be included in the tool. This is achieved in a similar manner as for the digital forms; however, instead of a graph of the digital measurements, a digital picture or scan of the strip log is included in a column. The picture of the strip log can be manipulated in a similar manner as previously described for images. When importing a strip log the depth at two points should be specified. These points provide a scale for the strip log that can be used to determine the depth of other points on the strip log. A depth column is included with the strip logs as well.

As previously described, the electrical logs, whether in digital form or strip log form, provide accurate depth information. The tool 100 allows for the accurate depth information of the electrical logs to be used to correct the depth information of the core data.

The depth information may also be corrected to account for True Vertical Depth (TVD) correction. This may be useful in providing vertical depth information for a well the is drilled at a non-vertical angle. This may also correct for deviated wells.

Figure 8:
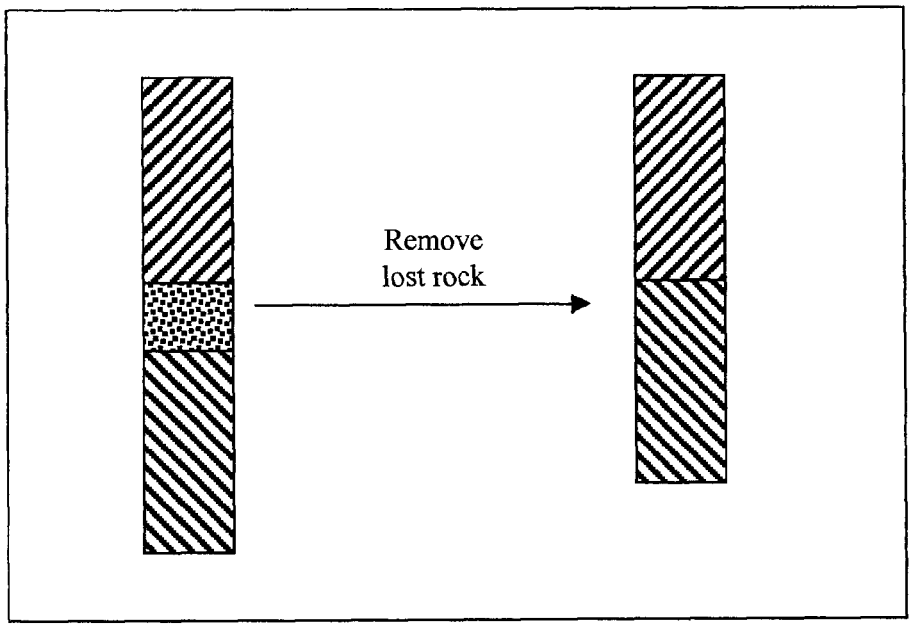
FIG. 8 shows in a schematic core material separated by loose material, in accordance with an aspect of the present disclosure.

The above description of the core sets has assumed that the core is solid and placed in the box without breaking or losing any material. However this is, generally, not the case. FIG. 8 shows in a schematic core material separated by loose material. The core material often contains loose material such as sand that falls away when the core is removed from the well. As a result a core is split into pieces. The pieces are placed in the box adjacent each other. As a result the depth contributed by the loose material is lost, and so the depth associated with the lower section may be higher then it should be. The same problem occurs if pieces of core material are not placed in the box, which can occur in the field where the well is being drilled.

Figure 9:
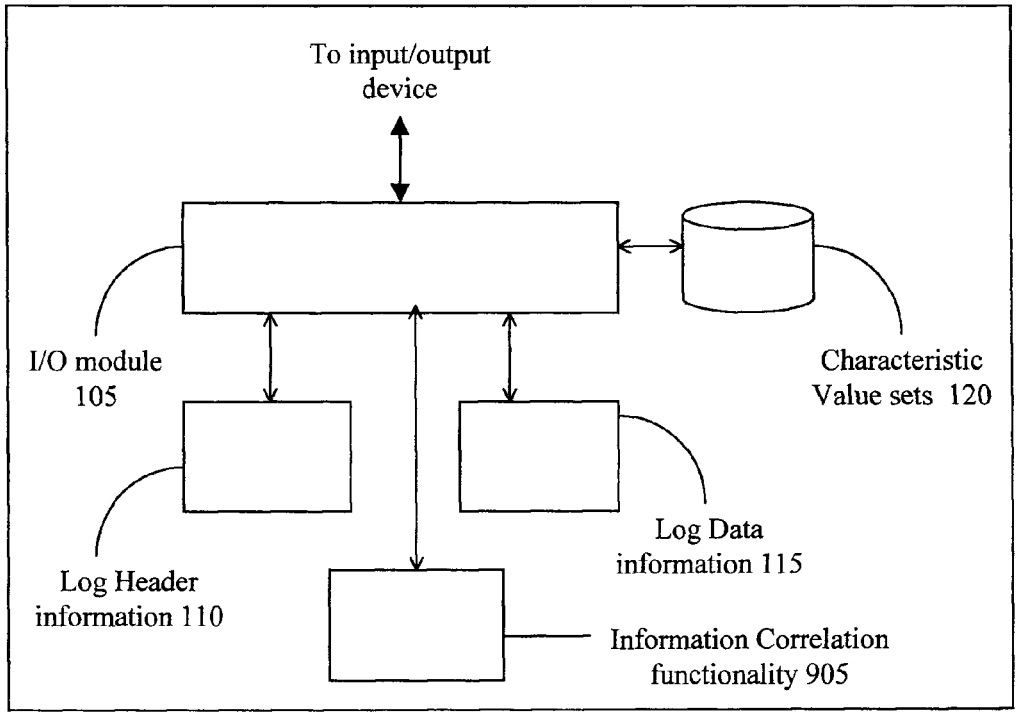
FIG. 9 shows in a functional schematic a tool including information correlation functionality, in accordance with an aspect of the present disclosure.

FIG. 9 shows in a functional schematic a tool 100 including information correlation functionality 905. The tool 100 allows for the correction of depth information. This can be achieved by inserting 'lost rock' into the position where the loose material or missing core material was. The electrical log information can be used to determine the location of the lost rock. By correlating characteristics of the intervals to the measurements of the electrical log using the information correlation functionality, which are associated with an accurate depth, either visually or programmatically, the depth of the intervals can be more accurately determined. The correlation may provide information as to the position of lost rock. The tool may then insert lost rock into the appropriate intervals to adjust the depths of the lower intervals to the electrical log correlated depth.

Figure 10:
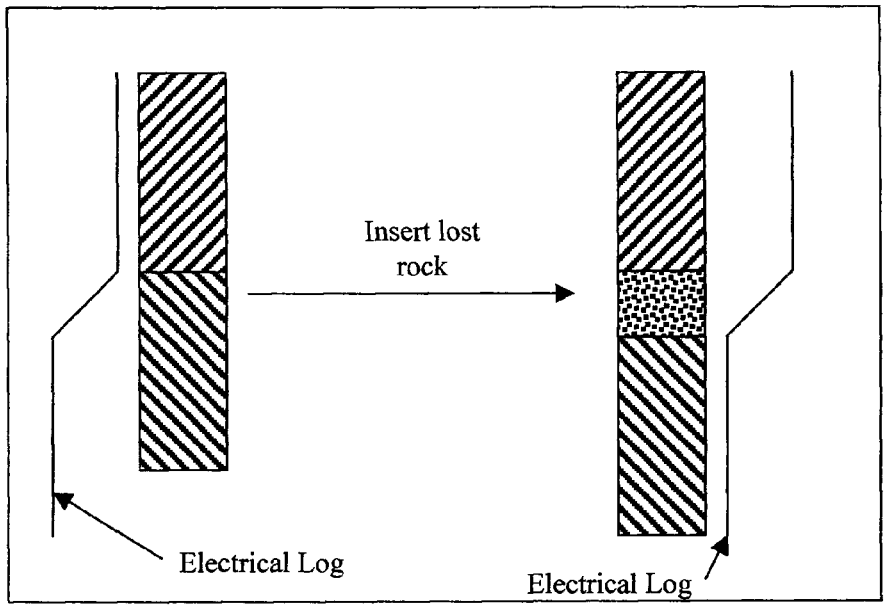
FIG. 10 depicts in a schematic a diagram of the insertion of lost rock, in accordance with an aspect of the present disclosure.

FIG. 10 depicts in a schematic a diagram of the insertion of lost rock based on the correlation of interval characteristics with the electrical log information.

In addition to inserting lost rock, the accurate electrical log information may be used to adjust the depth of the core set. When the electrical log information is displayed in a column, it may be clicked and dragged up or down. The values of the depth column associated with the electrical log are adjusted accordingly. The change or offset is stored as the Depth of Core information. By adjusting the electrical log such that characteristics of the electrical log align, or correlate, to intervals that contain core set characteristics that could produce the electrical log characteristics, more accurate depth information can be obtained for the core set. In determining the accurate depth of the core set the interval depth and the Depth of Core interval are added together (the Depth of Core offset may be negative).

In addition to the advantages disclosed above, the electrical log information may be used to detect and correct mislabelled box order (boxes that are out of sequence mislabelled) or pieces of core placed in the wrong box or wrong side of the box. Due to the conditions in the field, boxes may be labelled out of order or core samples may be improperly placed in a box. The electrical log information may be used to determine if core or boxes are out of order and if they are how to correct the order. This is achieved through the correlation of core set characteristics with the electrical log information.

The core is material that has been taken out of the well. Although the order that it is taken out from is normally maintained when placing in the material in boxes, depth information can be lost as described above, and the order of the boxes can be mixed up. On the other hand the electrical log information is measured from the material as it occurs in the well. Due to this, if core set characteristics can be correlated to electrical log characteristics, than an accurate depth of the interval characteristic can be determined. This correlation can be provided by the information correlation functionality provided by the tool 100.

It is possible to programmatically 'swap' data in one or more logging intervals with data in one or more other logging intervals to correct for errors indicated by collation of characteristic data to electrical log data (e.g., mixed up boxes).

The automated Log Manager tool 100 as described above requires the input of core set Log Data information 115 into the tool 100 in the form of characteristic-value pairs. As an alternative to inputting the values of the characteristics for a core set, it is possible to include the information as a scan or picture of an existing manual log. It is not possible to perform all of the analysis on a picture of Log Data, however it is advantageous in that it allows for the cataloguing of all core set information in one place. Companies, organizations and governments may have large amounts of data in the form of manual log data. It may not be desirable to input all of the information into the tool (such as information for wells no longer in use), however by easily allowing the inclusion of a scan or picture of the manual log, the tool can create a collection of all the information. The historical data, in the form of the manual log data scans, can be accessed using the same tool 100 that can enter more complete and accurate information from current core sets.

It may also be desirable to include a scan of manual logs for core sets that are not considered interesting, or worth further analysis. The tool 100 may be used advantageously to provide a complete core data management system that allows for the easy storage of images of core sets for record and book keeping, as well as a complete digital characterization of core set characteristics for a more complete analysis.

If an image of a manual log is entered for a core set, one or more of the characteristic columns of GUI 200 may also be displayed so that additional characteristic data may be entered. This may include the electrical log and electrical log depth columns and these columns may be used in the same manner as with a digital log to correct the depth recorded on the manual log. Although not required it may be advantageous to include the top and bottom depth of the manual core log. If this information is included it is possible to adjust the core on depth value of the image based on correlating features of the image with features of electrical log data as has been previously described.

The depth information may not visually correspond to the depth information contained on the scan of the manual core data log (i.e. the hand written depth information). The tool allows for filler blocks to be inserted into the depth column. The filler blocks are used to adjust the visual alignment of the intervals, but do not change the depth of the intervals. This is in contrast to the lost rock blocks which change the visual alignment of the intervals, as well as change the depths of subsequent depths.

Additionally, the note feature may be used to annotate the Log Data image. This may be used to indicate possible positions of lost rock, interesting features, etc.

The tool 100 may include both an image of a manual log, as well as the inputted digital characteristics of the log. The GUI may have an option to switch between displaying the image, and displaying the digital characteristics. Additionally or alternatively, the image could be displayed in a dialog.

The information associated with a well may be stored in a database. A mapping from database fields the appropriate classes or data structures of the tool 100 provides a way of storing and retrieving the information using the automated Log manager tool.

Figure 11:
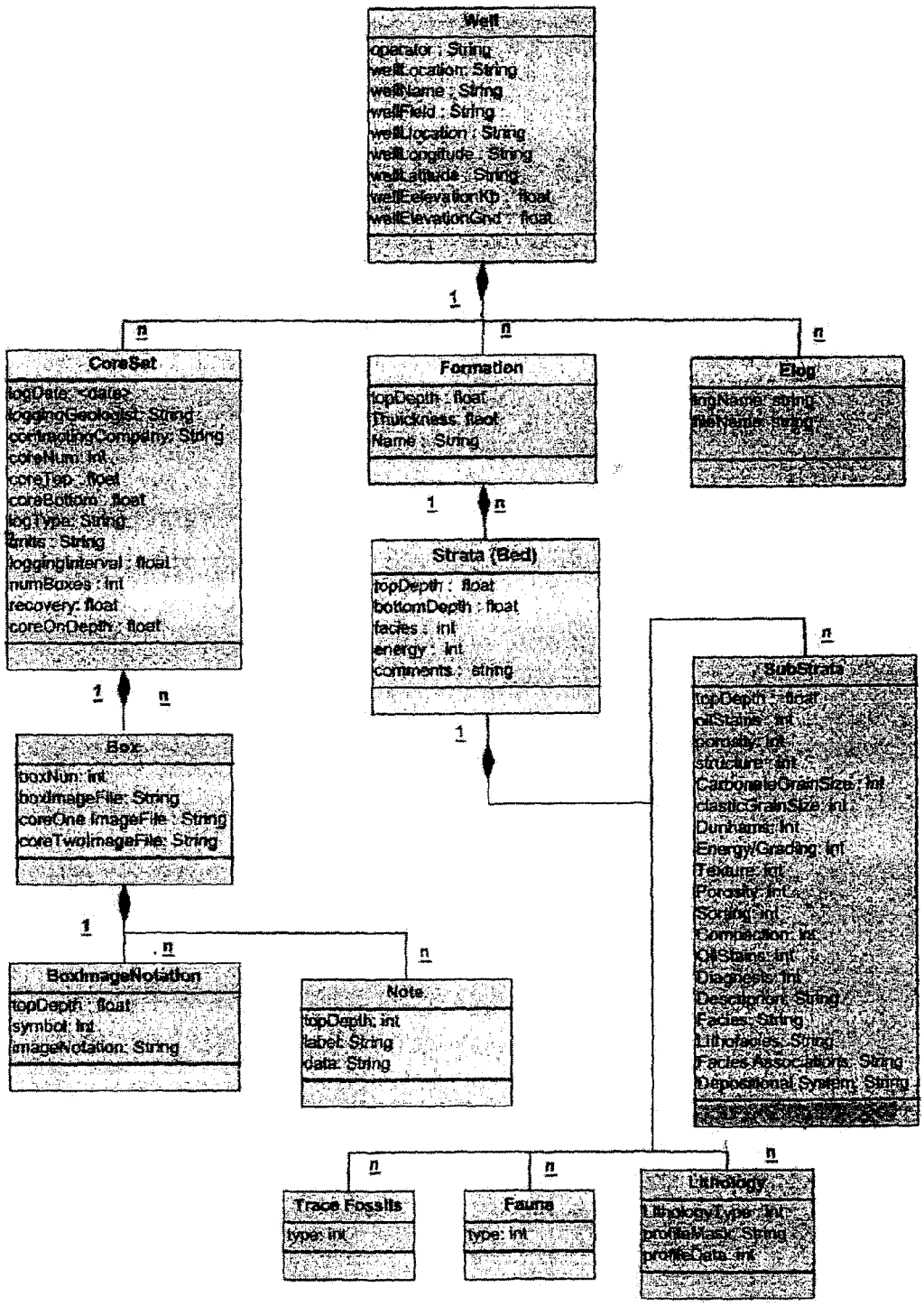
FIG. 11 shows in a schematic a data structure for storing the information, in accordance with an aspect of the present disclosure.

Additionally the tool 100 can provide a means for exporting information from the database or tool to a portable format. The portable format may describe the characteristics and characteristic value set, as well as the stored values associated with the various logging intervals. This information may be stored in various ways such as using XML. An example XML file is provided in Example Listing B. If additional information is included in describing the core set or well, such as electrical logs, analysis logs, or images, this information can be included in the file. FIG. 11 shows in a schematic a data structure for storing the information in accordance with the present disclosure.

Although other methods of exporting the information are possible, one way to create the portable file is create a compressed file containing all of the information. The tool 100 may import a compressed file and have all of the required information associated with a well core set. This can be used to transfer information, share the information, backup the information, etc. A consultant, company, government, etc. may use this format as a vendible product. They may perform the detailed characterization and analysis on core samples using the tool 100 and store the information in the portable file format. The portable files may be provided to others for some consideration, such as money.

As described above, the values of a characteristic are selected from a predetermined set. If the set is large, it may be tedious to continually search the list to find the desired value. As such the tool provides the ability to create a preferred set of values. The preferred set of values is utilized in the same fashion of as the Characteristic Value Set. The preferred value sets can be changed to add or remove values for characteristics. This can achieved in a dialog or screen that shows the various characteristics and all allowed values as well as the preferred values for the characteristics.

The tool has been described with reference to the GUI 200. The GUI 200 is designed for use on a computer with a large display, such as a laptop computer or desktop computer. Other front ends are possible. It is possible that the Automated Log Manager tool 100 act as a web server accessed from a web browser, so that the Log information can be entered and viewed from a web page. In this case the automated Log Manager web server module would be responsible for creating a page that displays the information and allows the characteristic values to be inputted. The Automated Log Manager tool 100 would be accessed using a web browser. The web server could require authentication to control access to the information. It may be desirable to allow for certain users to view information, but not input or edit values.

The automated Log Manager tool 100 may include a server that presents access to the tool 100 remotely. In this case a front end client can be used to access the information remotely. The server may control access to the information as described above. The front ends can be designed for various clients. A client may be a remote computer or laptop. It may also be a PDA or similar device.

The remote access may be provided using various network or communication methods. They may include connecting over the Internet, over a LAN, VPN or other types of networks. Access may also be provided wirelessly using wireless protocols such as IEEE 802.11a/b/g/n, 802.16 etc.

The graphical interface design may vary depending on the front end used. For example a PDA may be used to enter information wirelessly. This may be used advantageously when determining the characteristics of the core samples. The physical core sample may take up a large amount of space, and a wireless PDA provides a convenient means of entering the information into the tool 100. Due to the small screen size, the interface can be optimized for the input of characteristic values. It may not display the Log Header information, or provide image capabilities.

A remote front end may also be optimized for the display of information and so does not provide a way of inputting information. It is understood that one skilled in the art will recognize the various interfaces that can be used to meet specific needs or purposes.

The above description has described providing security measures to prevent certain users from changing or editing information. Security features may be included in the I/O module 105. It may allow for providing specific users specific rights. The rights may be assigned at different levels. For example a basic username/password may allow access to view information only, while a different username/password provides access to edit information. The rights may also be provided for specific wells and for specific core sets. For Example, a person entering information pertaining to a core set would have access to editing the core set information for that particular core set. The user may view but not edit the associated well information, or information for other core sets from the same well.

It is understood that various access security methods will be apparent to one skilled in the art.

The automated Log Manager tool 100 may include expert assist features. As has been described, the tool provides a way to correlate electrical log data with Core Data. The expert assist features can provide an automated way of analyzing the core log data and the electrical log data. It can provide information to a user as to the possible location to insert lost rock, based on correlating known characteristics with the electrical log information. The user may choose to accept the expert assist suggestions, accept the suggestions after modifying them (for example inserting two lost rock intervals instead of one) or reject the suggestions. The expert assist may optionally perform the suggestions automatically, without requiring the approval of a user.

The expert assist may also be used to identify switched boxes and suggest the correct order to a user. As for the lost rock suggestions, the user may accept the suggestions, accept them after modification, or reject them. The expert assist can re order the boxes automatically, without requiring the approval of a user.

The above description has focused on the characterization and analysis of core sets removed from a single well. The tool 100 can also be used to correlate and analyze well information for multiple wells. If multiple wells are within a common field, the information from the core set of each well can be analyzed to determine the characteristics of the field as a whole. The characteristics of core samples from various wells can be used to estimate the characteristics of the rock in the surrounding area and can be used to predict the position of a bed between wells.

This field wide information can be analyzed by the tool to provide possible well locations that could be profitable. Additionally, the field wide mapping that is possible using the automated log manager tool can be used to provide possible paths that can be used for horizontal drilling. For example the tool may be used to estimate the likely location of beds or strata that contain interesting material, such as oil, minerals, etc. This estimated path may then be used to optimize drilling locations, and horizontal drilling paths.

The automated Log Manager tool 100 has been described as providing a linear scale as the logging interval. It is possible to specify logging scales that use different intervals for part of the core (e.g., finer intervals for more significant rock). It is also possible to use non linear (e.g. logarithmic) logging scales. This may be beneficial for providing coarse characterization of sections that do not contain interesting features, while allowing for more detailed characterization for sections with interesting features.

Although the tool 100 has been described with specific examples of clastic and carbonate type rocks, it is intended that the tool 100 can be used to characterize and analyze different rock types, such as hard rock, sedimentary rock, coal etc. This is achieved by specifying the characteristics used to describe the rock, as well as the allowed values for the characteristics. A template may be used to describe the characteristics to use when characterizing and analyzing different rock types.

Furthermore it should be apparent that, although the tool 100 has been fully described as being used for the characterization and analysis of rock samples, it can be used to capture, and possibly correlate, any characteristics that are observed and recorded over measured intervals. This could be useful for characterizing railroad tracks. The tracks may be visually inspected at regular intervals and these characteristics entered as values into the tool 100. Additionally the tracks may have characteristics measurements taken along their length (such as rail wear or metal quality x-ray data). The tool can be used to input, correlate and analyze this information. In a similar manner the tool may be used to characterize and analyze, roads, sewers, power lines, etc.

The tool may also be used to characterize and analyze buildings. For example, a high rise building may have regular maintenance which includes noting the building characteristics at each floor (for example loose concrete, stress fractures). Electrical measurements can be taken to determine various conditions, such as surface temperature, wind speed, radiant heat (which may indicate the quality of insulation).

Example Listing B

An example XML file that may be used to store core set information can be found in the attached Computer Program Listing Appendix, herein incorporated by reference. Two copies of the Computer Program Listing Appendix have been submitted herewith, each containing a single file, 12300598US.txt (92 kB), created on Sep. 6, 2013.

The system and methods according to the present patent disclosure may be implemented by any hardware, software or a combination of hardware and software having the above described functions. The software code, either in its entirety or a part thereof, may be stored in a computer-readable memory. Further, a computer data signal representing the software code which may be embedded in a carrier wave may be transmitted via a communication network. Such a computer-readable memory and a computer data signal are also within the scope of the present patent disclosure, as well as the hardware, software and the combination thereof.

While particular embodiments of the present patent disclosure have been shown and described, changes and modifications may be made to such embodiments without departing from the true scope of the patent disclosure.

What is claimed is:

1. A computer implemented method of normalizing characterization information comprising:

defining and storing a plurality of characteristics;

for each characteristic defining and storing a set of allowed values;

defining and storing a logging interval;

at a plurality of logging intervals, selecting a value from the set of allowed values for a characteristic of the plurality of characteristics;

storing the selected value for the characteristics at the plurality of logging intervals as characterization information of core set log data;

receiving electrical log data; and storing the electrical log data; and correlating the electrical log data with the characterization information of the core set log data.

2. The method as claimed in claim 1, wherein defining the plurality of characteristics comprises defining characteristics for characterizing one of: clastic rocks, carbonate rocks, hard rocks and other rock types.

3. The method as claimed in claim 1, further comprising:

receiving core analysis data; and storing the core analysis data.

4. The method as claimed in claim 1, further comprising:

receiving core image data; and storing the core image data.

5. A non-transitory computer-readable medium storing instructions or statements for use in executing in a computer a method of normalizing characterization information comprising:

defining a plurality of characteristics;

for each characteristic defining a set of allowed values;

defining a logging interval;

at a plurality of logging intervals, selecting a value from the set of allowed values for a characteristic of the plurality of characteristics;

storing the selected value for the characteristics at the plurality of logging intervals as characterization information of core set log data;

receiving electrical log data; and storing the electrical log data; and correlating the electrical log data with the characterization information of the core set log data.

6. A computing system for correlating log information, the computing system configured to:

receive a selection, at a plurality of logging intervals, of a value from a set of allowed values for a characteristic of a plurality of characteristics;

store the selected value for the characteristics at the plurality of logging intervals as characterization information of core set log data;

receive and store specified electrical log data; and correlate the electrical log data with the characterization information of the core set log data.

7. The system as claimed in claim 6, wherein the core set log data comprises an image of a manual core set log data information.

8. The system as claimed in claim 7, wherein a top depth and a bottom depth is associated with the image.

9. The system as claimed in claim 6, wherein the electrical log data comprises an image of a strip log.

10. The system as claimed in claim 6, wherein the system is further configured to correlate depth information associated with the electrical log data with depth information associated with the core set log data.

11. The system as claimed in claim 6, wherein the system is further configured to communicate with a remote front end, the remote front end comprising a means for inputting core set log data.

12. The system as claimed in claim 6, wherein the system is further configured to store core set analysis information.

13. The system as claimed in claim 6, wherein the system is further configured to import core set images, and add notes to core set images.

14. The system as claimed in claim 6, wherein the core set log data includes lithology information for a plurality of logging intervals and the system further comprises a weathering module for applying a weathering mask to the lithology characteristic based on values of at least one other characteristic.

15. The system as claimed in claim 14, wherein the at least one other characteristic includes grain size and energy gradient.

16. The system as claimed in claim 14, wherein the at least one other characteristic includes Dunham's characterization.

17. The system as claimed in claim 6, further comprising a web server, the web server for providing web pages for inputting and displaying core set log data.

* * * * *

UNITED STATES PATENT AND TRADEMARK OFFICE

CERTIFICATE OF CORRECTION

PATENT NO. : 8,577,614 B2
APPLICATION NO. : 12/300598
DATED : November 5, 2013
INVENTOR(S) : Robert Norris It is certified that error appears in the above-identified patent and that said Letters Patent is hereby corrected as shown below:

On the title page, after line (86) entitled "§371 (c)(1), (2), (4) Date", please insert the date as follows.

-- July 7, 2009 --

On the title page, after line (87) entitled "PCT Pub. Date", please insert the date as follows.

-- November 22, 2007 --

Signed and Sealed this
Twenty-fifth Day of March, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,577,614 B2
APPLICATION NO. : 12/300598
DATED : November 5, 2013
INVENTOR(S) : Norris et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1368 days.

Signed and Sealed this
Twenty-second Day of September, 2015

Michelle K. Lee

Michelle K. Lee
*Director of the United States Patent and Trademark Office*